US008309021B2

(12) United States Patent
Lyublinski et al.

(10) Patent No.: US 8,309,021 B2
(45) Date of Patent: Nov. 13, 2012

(54) CORROSION MANAGEMENT SYSTEMS FOR CONTROLLING, ELIMINATING AND/OR MANAGING CORROSION

(75) Inventors: Efim Ya Lyublinski, Solon, OH (US); Yefim Vaks, South Euclid, OH (US)

(73) Assignee: Northern Technologies International Corporation, Beachwood, OH (US)

( * ) Notice: Subject to any disclaimer, the term of this patent is extended or adjusted under 35 U.S.C. 154(b) by 373 days.

(21) Appl. No.: 12/597,430

(22) PCT Filed: Apr. 25, 2008

(86) PCT No.: PCT/US2008/005392

§ 371 (c)(1), (2), (4) Date: Apr. 23, 2010

(87) PCT Pub. No.: WO2008/134016

PCT Pub. Date: Nov. 6, 2008

(65) Prior Publication Data

US 2010/0209289 A1 Aug. 19, 2010

Related U.S. Application Data

(60) Provisional application No. 60/926,314, filed on Apr. 26, 2007.

(51) Int. Cl.

| | |
|---|---|
| ***C23F 11/02*** | (2006.01) |
| ***C23F 11/00*** | (2006.01) |
| ***G05D 9/00*** | (2006.01) |
| ***B08B 9/00*** | (2006.01) |
| ***B08B 5/00*** | (2006.01) |
| ***F16K 24/00*** | (2006.01) |
| ***B67D 5/00*** | (2006.01) |
| ***B05B 17/04*** | (2006.01) |
| ***B65D 90/02*** | (2006.01) |

(52) U.S. Cl. ..... 422/9; 422/10; 422/14; 422/106; 422/119; 134/22.1; 134/31; 137/587; 222/4; 239/4; 239/74; 220/565

(58) Field of Classification Search ..... 422/9–10, 422/14, 106, 119; 134/22.1, 31; 137/587; 222/4; 239/4, 74; 220/565

See application file for complete search history.

(56) References Cited

U.S. PATENT DOCUMENTS

| | | | | |
|---|---|---|---|---|
| 2,634,223 A * | 4/1953 | Clendenin et al. | ..... | 148/264 |
| 5,137,694 A * | 8/1992 | Copeland et al. | ..... | 422/106 |
| 5,184,939 A * | 2/1993 | Solomon et al. | ..... | 417/41 |

* cited by examiner

*Primary Examiner* — Jill Warden
*Assistant Examiner* — Monzer Chorbaji
(74) *Attorney, Agent, or Firm* — Hudak, Shunk & Farine Co. LPA

(57) ABSTRACT

The present invention generally relates to corrosion management systems designed to deliver corrosion protection and/or the management of corrosion to a top portion of an enclosure (e.g., storage tanks, cisterns, containers, etc.). In one embodiment, the present invention relates to corrosion management systems designed to deliver corrosion protection and/or the management of corrosion to a top portion, or roof portion, of an enclosure where such a system includes one or more dispensers designed to deliver at least one corrosion inhibitor to a system designed to protect a top portion of an enclosure (e.g., storage tanks, cisterns, containers, etc.).

12 Claims, 15 Drawing Sheets

CORROSION MANAGEMENT SYSTEMS FOR CONTROLLING, ELIMINATING AND/OR MANAGING CORROSION

FIELD OF THE INVENTION

The present invention generally relates to corrosion management systems designed to deliver corrosion protection and/or the management of corrosion to a top portion of an enclosure (e.g., storage tanks, cisterns, containers, etc.). In one embodiment, the present invention relates to corrosion management systems designed to deliver corrosion protection and/or the management of corrosion to a top portion, or roof portion, of an enclosure where such a system includes one or more dispensers designed to deliver at least one corrosion inhibitor to a system designed to protect a top portion of an enclosure (e.g., storage tanks, cisterns, containers, etc.).

BACKGROUND OF THE INVENTION

Various systems are currently available that are designed to protected a top portion of an enclosure (e.g., storage tanks, cisterns, containers, etc.). Such systems include coatings, fiberglass, and/or polymeric linings. However, such systems can only be economically applied during the construction of new enclosures, or on existing enclosures that have been taken out of service and fully cleaned. Additionally, currently available lining systems also cause contamination issues to the material being stored within the enclosures (e.g., petroleum, gasoline, other liquids, etc.). Another shortcoming of lining systems is that they cannot be readily replaced unless, as noted above, the enclosure is taken out of service, emptied and cleaned.

SUMMARY OF THE INVENTION

The present invention generally relates to corrosion management systems designed to deliver corrosion protection and/or the management of corrosion to a top portion of an enclosure (e.g., storage tanks, cisterns, containers, etc.). In one embodiment, the present invention relates to corrosion management systems designed to deliver corrosion protection and/or the management of corrosion to a top portion, or roof portion, of an enclosure where such a system includes one or more dispensers designed to deliver at least one corrosion inhibitor to a system designed to protect a top portion of an enclosure (e.g., storage tanks, cisterns, containers, etc.).

In one embodiment, the present invention relates to a method for providing corrosion protection to a container subject to corrosion comprising the steps of: (A) providing a device comprising at least one corrosion inhibiting portion contained therein, the corrosion inhibiting portion comprising at least one vapor phase corrosion inhibitor, wherein the device further comprises a delivery system for achieving the selective and controlled release of the at least one vapor phase corrosion inhibitor; (B) placing the device into communication with the container subject to corrosion; and (C) permitting the delivery system to selectively control the release of the vapor phase corrosion inhibitor into the container subject to corrosion over an extended period of time, wherein the device is designed to respond to the level of one or more liquids contained in the container to be protected.

In another embodiment, the present invention relates to a device for providing corrosion protection to a container comprising: a sealable enclosure, wherein the sealable enclosure comprises at least one corrosion inhibiting portion contained therein, the corrosion inhibiting portion comprising at least one vapor phase corrosion inhibitor; at least one delivery system that is in communication with the sealable enclosure, wherein the delivery system is designed to permit the selective and controlled release of the at least one vapor phase corrosion inhibitor to an area external the sealable enclosure; and at least one feedback system, wherein the feed back system is designed to release the one or more vapor phase corrosion inhibitor in response to the level of one or more liquids contained in the container to be protected.

In still another embodiment, the present invention relates to A device for providing corrosion protection to a container comprising: a sealable enclosure, wherein the sealable enclosure comprises at least two corrosion inhibiting portions contained therein, the corrosion inhibiting portions each comprising at least one vapor phase corrosion inhibitor; at least one delivery system that is in communication with the sealable enclosure, wherein the delivery system is designed to permit the selective and controlled release of the vapor phase corrosion inhibitors to an area external the sealable enclosure; and at least one feedback system, wherein the feed back system is designed to release the vapor phase corrosion inhibitors in response to the level of one or more liquids contained in the container to be protected, wherein the device contains at least two different vapor phase corrosion inhibiting compounds.

DETAILED DESCRIPTION OF THE INVENTION

Figure 1A:
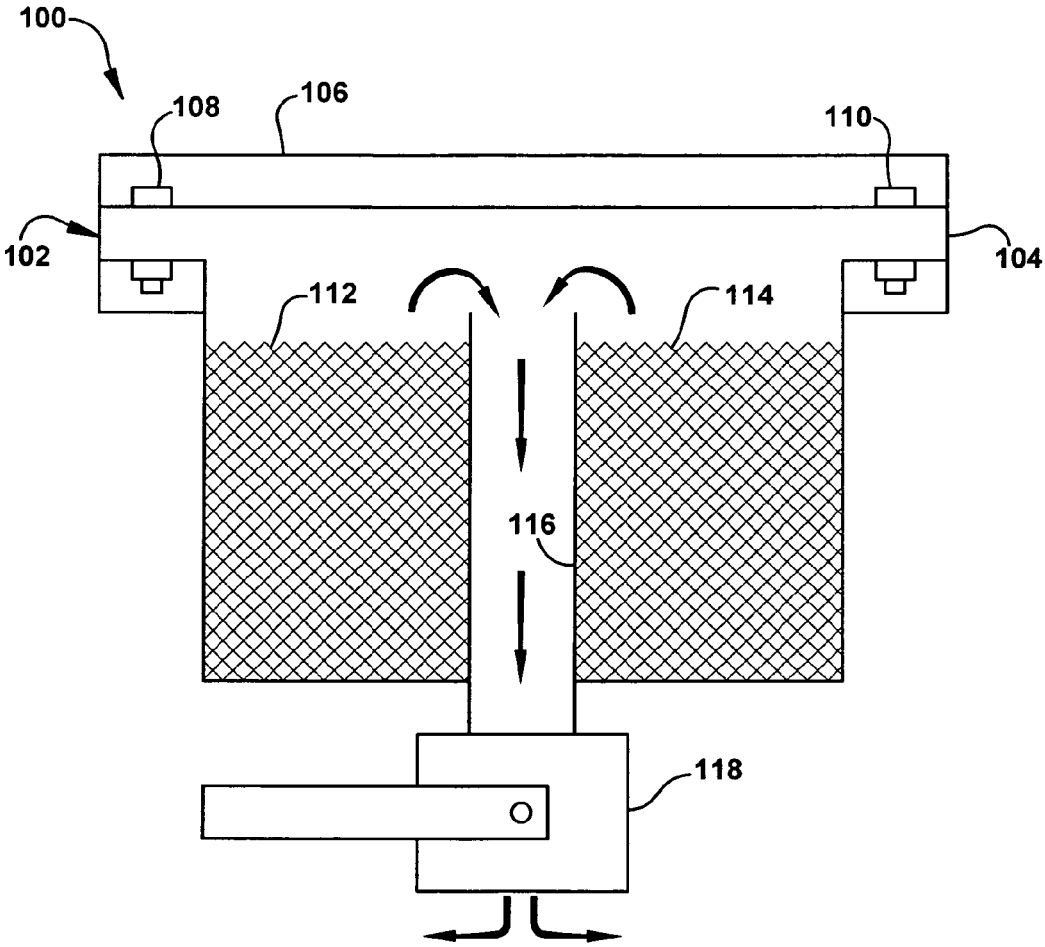
FIGS. 1A through 3C are cross-sectional illustrations of various dispensers for dispensing at least one corrosion inhibiting compound in accordance with one or more systems of the present invention.

The present invention generally relates to corrosion management systems designed to deliver corrosion protection and/or the management of corrosion to a top portion of an enclosure (e.g., storage tanks, cisterns, containers, etc.). In one embodiment, the present invention relates to corrosion management systems designed to deliver corrosion protection and/or the management of corrosion to a top portion, or roof portion, of an enclosure where such a system includes one or more dispensers designed to deliver at least one corrosion inhibitor to a system designed to protect a top portion of an enclosure (e.g., storage tanks, cisterns, containers, etc.).

Initially, the dispensers and/or systems of the present invention can be utilized by themselves or in conjunction with one or more additional systems designed to reduce, eliminate, mitigate and/or manage corrosion in at least one other portion of an enclosure.

The corrosion management systems of the present invention described herein relates generally to systems, devices and/or methods for preventing and/or reducing the occurrence of corrosion in a variety of articles including, but not limited to, enclosures or tanks (e.g., storage tanks, septic tanks, fuel tanks, etc.); containers (e.g., shipping containers, storage containers, etc.); semi-closed systems (e.g., fuel systems, septic systems, reservoirs, etc.); and/or closed systems (e.g., waste disposal systems, waste disposal drums or containers, etc.). More specifically, the present invention relates to systems, devices or methods for preventing and/or reducing the occurrence of corrosion in a variety of articles including, but not limited to, metallic tanks; metallic containers; semi-closed systems; and/or closed systems which are constructed partially or totally from metal (e.g., steel, iron, copper, brass, aluminum, etc.).

As used throughout the text and claims, a semi-closed system means a system which is opened periodically to replenish, fill or deposit something therein (e.g., a fuel tank, a storage tank, etc.). As used throughout the text and claims, a tank includes any type of closed storage tank or tank designed to hold one or more liquids and/or gases (e.g., a fuel tank, an above ground storage tank). As used throughout the text and claims, a storage enclosure means any storage enclosure, be it semi-closed or closed, that is used to store at least one liquid, gas, or combination thereof.

Additionally, as used throughout the text and claims, corrosion includes not only tarnishing, rusting and other forms of corrosion, but also includes any detrimental or unwanted degradation of an article to be protected. As such, when the phrases "corrosion inhibiting compound(s)" or "corrosion inhibitor(s)" are used herein, these phrases also include tarnish inhibiting compound(s) or tarnish inhibitor(s). In one embodiment, the corrosion inhibiting compound or compounds utilized in conjunction with the present invention are selected from one or more volatile or vapor phase corrosion inhibitors, one or more soluble corrosion inhibitors, or any suitable combinations thereof.

As used throughout the text and claims, corrosion inhibitor means any compound, whether volatile or not, which inhibits at least one form of corrosion or degradation from occurring on an object to be protected. As used throughout the text and claims, a soluble corrosion inhibitor means any compound, be it solid, liquid, or gas, that is soluble in at least one liquid. As used throughout the text and claims, volatile phase corrosion inhibitor and vapor phase corrosion inhibitor are used interchangeably and both mean that such types of corrosion inhibitors are transferred to the surface of the item/article/surface to be protected by condensation of the volatile/vapor phase corrosion inhibitor's vapor on the surface of the item/article/surface to be protected.

As used throughout the text and claims, a sealable enclosure means any enclosure which can be sealed by any suitable means so as to maintain a high concentration of one or more corrosion inhibiting compounds, one or more vapor phase corrosion inhibiting compounds, or one or more volatile corrosion inhibiting compounds remote from an exterior environment until the release of such one or more inhibiting compounds is desired into an environment that is exterior to the sealable enclosure. Additionally, it should be noted that in the following text, range and/or ratio limits may be combined.

In the case where the present invention utilizes a volatile or vapor phase corrosion inhibitor, any suitable volatile or vapor phase corrosion inhibitors can be used in this portion of the present invention. U.S. Pat. Nos. 4,290,912; 5,320,778; and 5,855,975 disclose vapor phase or volatile corrosion inhibitors, and are incorporated herein by reference in their entirety for their teachings of such compounds. For example, useful vapor phase or volatile corrosion inhibitors include, but are not limited to, benzotriazole, and mixtures of benzoates of amine salts with benzotriazole, nitrates of amine salts, and $C_{13}H_{26}O_2N$.

In one embodiment, the systems of the present invention contain at least one dispenser, as is illustrated in FIGS. 1A through 3C, 6, 7 and 8, that is designed to deliver at least one corrosion inhibitor. Any corrosion inhibitor can be utilized in the present invention. For example, liquid, gas, or even solid corrosion inhibitors can be utilized in conjunction with the present invention. In another embodiment, the present invention is designed to deliver, via at least one dispenser, at least one volatile or vapor phase corrosion inhibitor.

It should be noted that although the Figures of the present invention illustrate certain locations for the dispensers in connection with the present invention, such locations are only exemplary. Accordingly, the dispensers of the present invention are not limited to any one location, or set of locations. Additionally, it should be noted that features present in one embodiment can be mixed and matched with features of one or more other embodiments to yield a tailored non-illustrated embodiment.

Given the above, the devices of the present invention permit the release of one or more volatile or vapor phase corrosion inhibitors into a desired closed or semi-closed environment over an extended period of time. Given that the devices according to the present invention can be, if so desired, replaced and/or replenished, the devices of this portion of the present invention do not have a set life expectancy. For example, the devices of this portion of the present invention could be designed to last any where from about 1 month to about 50 years. In another embodiment, the life expectancy of the devices of this portion of the present invention is from about 6 months to about 25 years, from about 1 year to about 15 years, or from about 2 years to about 10 years, or even from about 3 to about 5 years. Here, as well as elsewhere in the specification and claims, individual range limits can be combined to form non-disclosed and/or non-stated ranges.

It will be apparent to one of ordinary skill in the art, upon reading the present specification, that the devices according to this portion of the present invention could be produced with an indefinite range of life expectancies. As such, this portion of the present invention is not limited to the above life expectancies. Rather, one of ordinary skill in the art would, upon reading the present specification and taking into consideration the environment in which the device will be placed, be able to design a device for this portion of the present invention with any desired life expectancy.

With regard to FIGS. 1A through 3C, these Figures illustrate various dispenser embodiments wherein like reference numerals refer to like parts. Turning to FIG. 1A, FIG. 1A is an illustration of one embodiment of tank top corrosion inhibitor dispensing system according to the present invention. In the embodiment of FIG. 1A, dispenser 100 comprises a resealable housing 102 formed from base 104 and top 106. Resealable housing 102 can be open and closed via fasteners 108 and 110 and can be formed from any suitable material that is both durable and watertight. By durable it is meant that the material that is used to form housing 102 should remain durable and structurally intact for at least about 6 months. By watertight it is meant that water vapor should not be able to pass through the material used to form housing 102. Suitable materials for the formation of housing 102 include, but are not limited to, metal, ceramic, polymers, or combinations of two or more thereof. In one embodiment, a rust resistant metal (e.g., aluminum or stainless steel), ceramic or polymer material is used to form housing 102. Suitable polymer materials include, but are not limited to, polystyrenes, polypropylenes, polyethylenes, polyolefins, or combinations of two or more thereof. In another embodiment, the polymer used to form housing 102 of the present invention contain one or more metallized layers (e.g., vapor deposited aluminum layers). Such metallized films are known in the art and as such a discussion thereof is omitted for the sake of brevity. If formed from a polymer material, housing 102 can be formed from any suitable technique including, but not limited to, blow molding, casting, extrusion, etc. In some embodiments, the polymer materials that are used to form housing 102 can further include a wide variety of polymer modification compounds including, but not limited to, processing aids, UV stabilizers, flame-retardants, anti-mildew compounds, anti-static compounds, anti-bacterial compounds, dyes, colorants, or any combination of two or more thereof.

Regarding resealable housing 102, housing 102 is not limited to just the fastener embodiment discussed above. Rather, any suitable type of sealing system that permits repeated opening and closing of housing 102 can be used. Suitable sealing systems include, but are not limited to, tape, hinges, screws, bolts, resealable adhesives, or combinations of two or more thereof.

Device 100 further comprises corrosion inhibitor sections 112 and 114 that are formed from any suitable corrosion inhibiting compound or combination of compounds. In one embodiment, corrosion inhibiting sections 112 and 114 are formed from one or more volatile, or vapor phase, corrosion inhibiting compounds. Such one or more volatile, or vapor phase, corrosion inhibiting compounds can be either liquid or solid compounds that produce a vapor phase corrosion inhibitor that is transmitted down supply tube 116 to valve 118. Valve 118 is designed to connect to the top of an aboveground storage tank, or some other enclosure as described above. Valve 118 can either be manually controlled or can be remotely controlled by, for example, a computer. Once valve 118 is opened, then volatile, or vapor phase, corrosion inhibitor is permitted to flow into the empty space at the top of a storage tank (not shown). While not wishing to be bound to any one theory, due to the law of partial pressure and equilibrium corrosion inhibitor is supplied to an aboveground storage tank thereby providing protection to the interior surfaces of the tank that are exposed (i.e., not covered by the liquid being stored within the tank.

Regarding supply tube 116 and valve 118, these portions of device 100 can be manufactured from any of the materials discussed above for housing 102. Additionally, since such devices are known in the art, a detailed discussion of the exact structures of supply tube 116 and valve 118 is omitted herein for the sake of brevity.

Regarding corrosion inhibiting sections 112 and 114 these sections can be foam-based corrosion inhibiting devices known to those of skill in the art. In another embodiment, corrosion inhibiting sections 112 and 114 can be formed from degradable polymer structures like those described in co-pending and co-owned PCT Patent Application No. PCT/US08/04398, filed on Apr. 4, 2008.

Figure 1B:
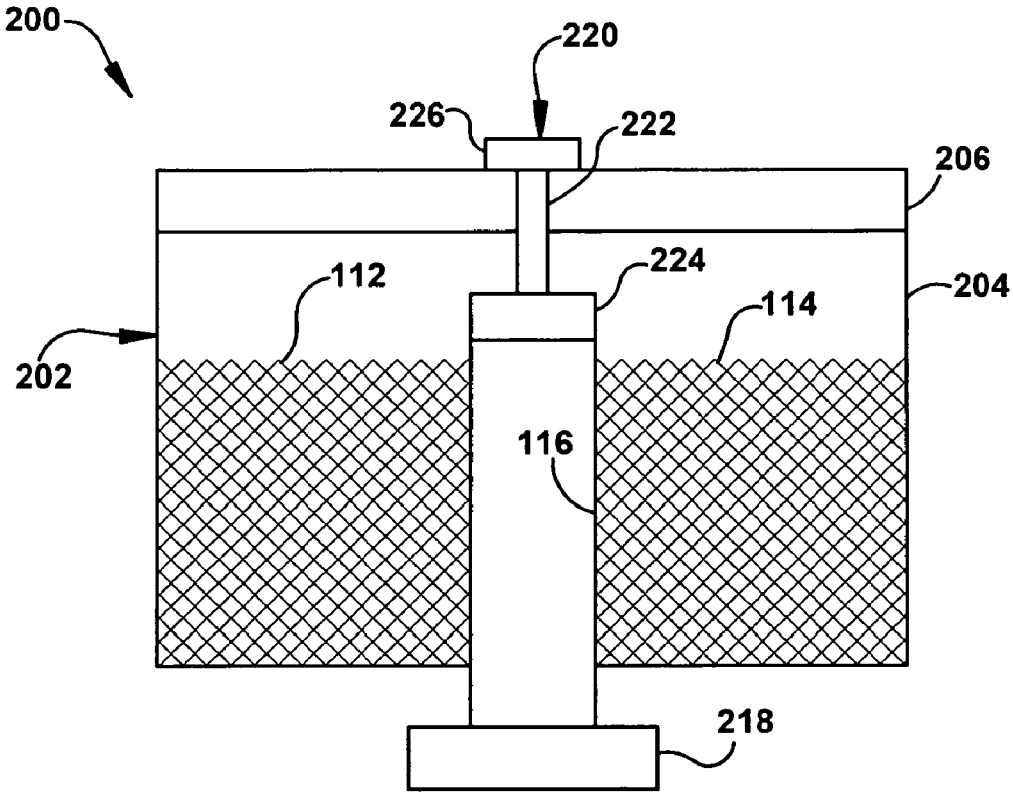

Turning to FIG. 1B, FIG. 1B illustrates a device 200 in accordance with another embodiment of the present invention. In FIG. 1B, like reference numerals refer to like parts. Device 200 is similar to device 100 except that housing 202 is formed from a base 204 and a cover portion 206. In this embodiment, cover portion 206 is resealable and can be opened and closed repeatedly. In one embodiment, cover portion 206 is a threaded cap that screws onto base portion 204. However, the present invention is not limited to just this arrangement. Device 200 also comprises at least one resealable cover structure 220 that is used to prevent the outflow of corrosion inhibitor from device 200.

In one embodiment resealable cover structure 220 is formed from a threaded post 222 that is attached at one end to an appropriate sized stopper portion 224 that blocks the outflow of corrosion inhibitor when the cover is in its downward most position. In order to release corrosion inhibitor from device 200, a knob 226 is turned in order to cause stopper portion 224 to rise (see FIG. 1C). Device 200 can be formed from the same or similar materials that are used to form device 100. Additionally, in device 200 valve 118 is replaced by a coupling 218. Coupling 218 can de designed to be attached to a wide range of piping or tank inputs so as to permit delivery of the one or more corrosion inhibitors contained in device 200 to the interior space of, for example, a tank or other enclosure.

Figure 1C:
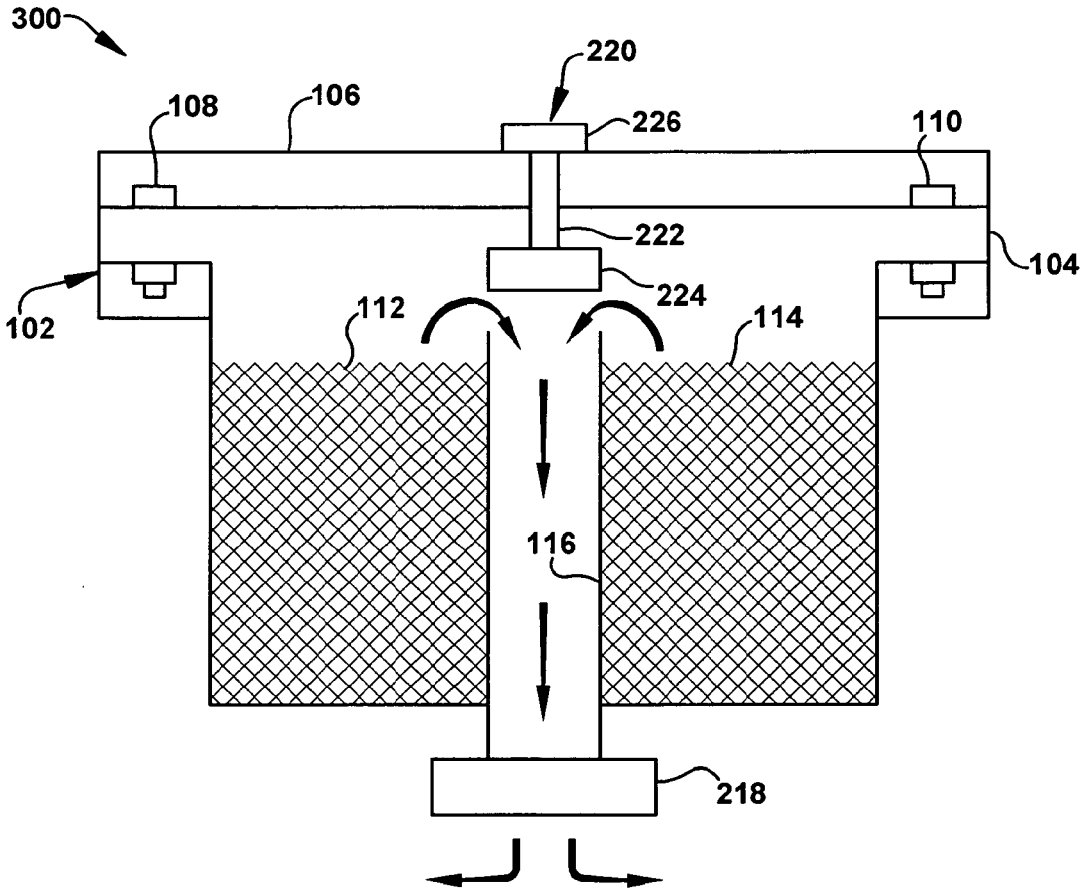

Turning to FIG. 1C, FIG. 1C illustrates a device 300 in accordance with another embodiment of the present invention. In FIG. 1C, like reference numerals refer to like parts. Device 300 is similar to device 100 except that it does not include valve 118. In device 200, valve 118 is replaced by a coupling 218. Coupling 218 can de designed to be attached to a wide range of piping or tank inputs so as to permit delivery of the one or more corrosion inhibitors contained in device 200 to the interior space of, for example, a tank or other enclosure. Device 300 can be formed from the same or similar materials that are used to form the other devices of the present invention.

As would be apparent to those of skill in the art, the devices of the present invention are not limited to just the use of resealable cover structure 220. Rather any type of manual or remotely controlled valve can be used in place of resealable cover structure 220 to permit the selective delivery of the one or more corrosion inhibitors to the interior of an enclosure (e.g., a aboveground storage tank).

Figure 2A:
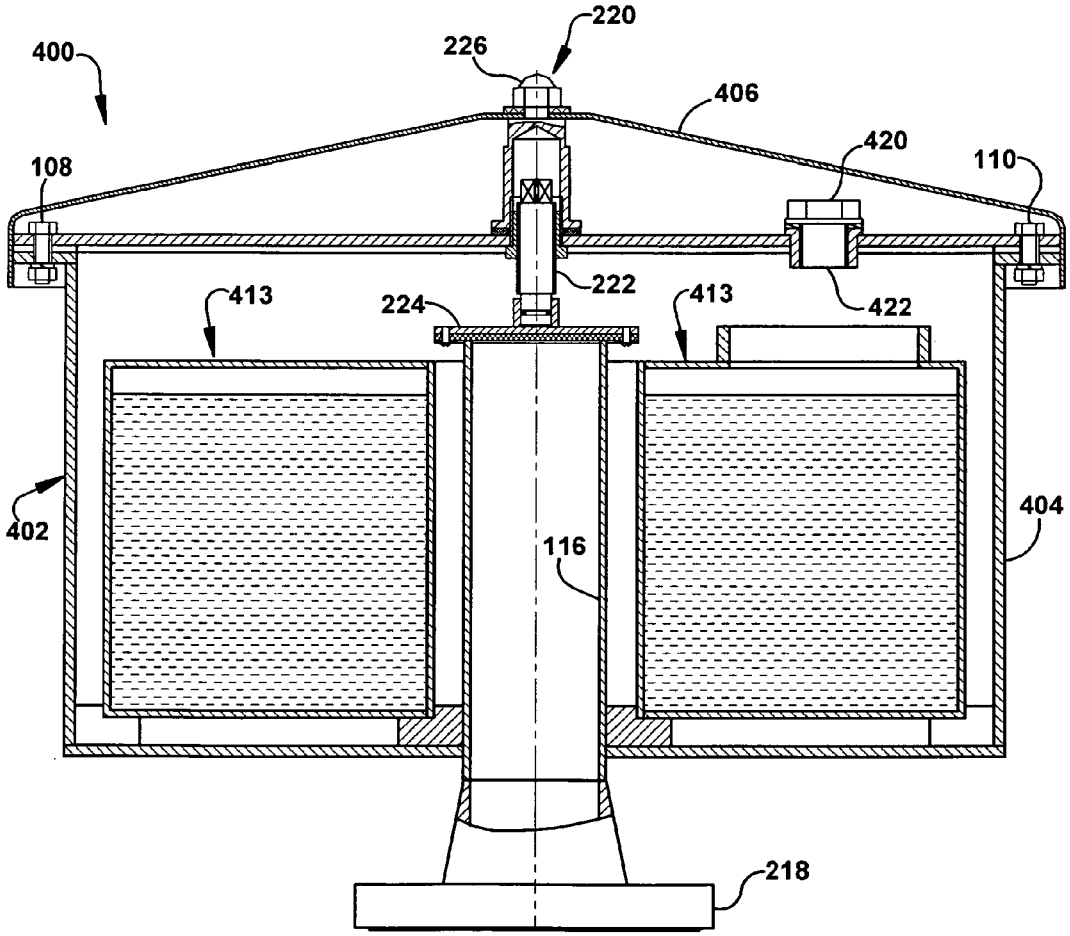

Turning to FIG. 2A, FIG. 2A illustrates a device 400 in accordance with another embodiment of the present invention. In FIG. 2A, like reference numerals refer to like parts. Device 400 is similar to device 100 except that housing 102 is replaced by a housing 402 that has a sloped cover 406 and a base 404. Additionally, device 400 has a single corrosion inhibitor reservoir 413 that is able to be replenished via the combination of plug 420 and fill-hole 422. When plug 420 is removed, additional corrosion inhibitor can be added to reservoir 413 via fill-hole 422. This permits device 400 to remain in service longer without having to remove device 400 from the top of an enclosure (e.g., an aboveground storage tank) and service the device offsite. Device 400 can be formed from the same or similar materials that are used to form the other devices of the present invention.

Figure 2B:
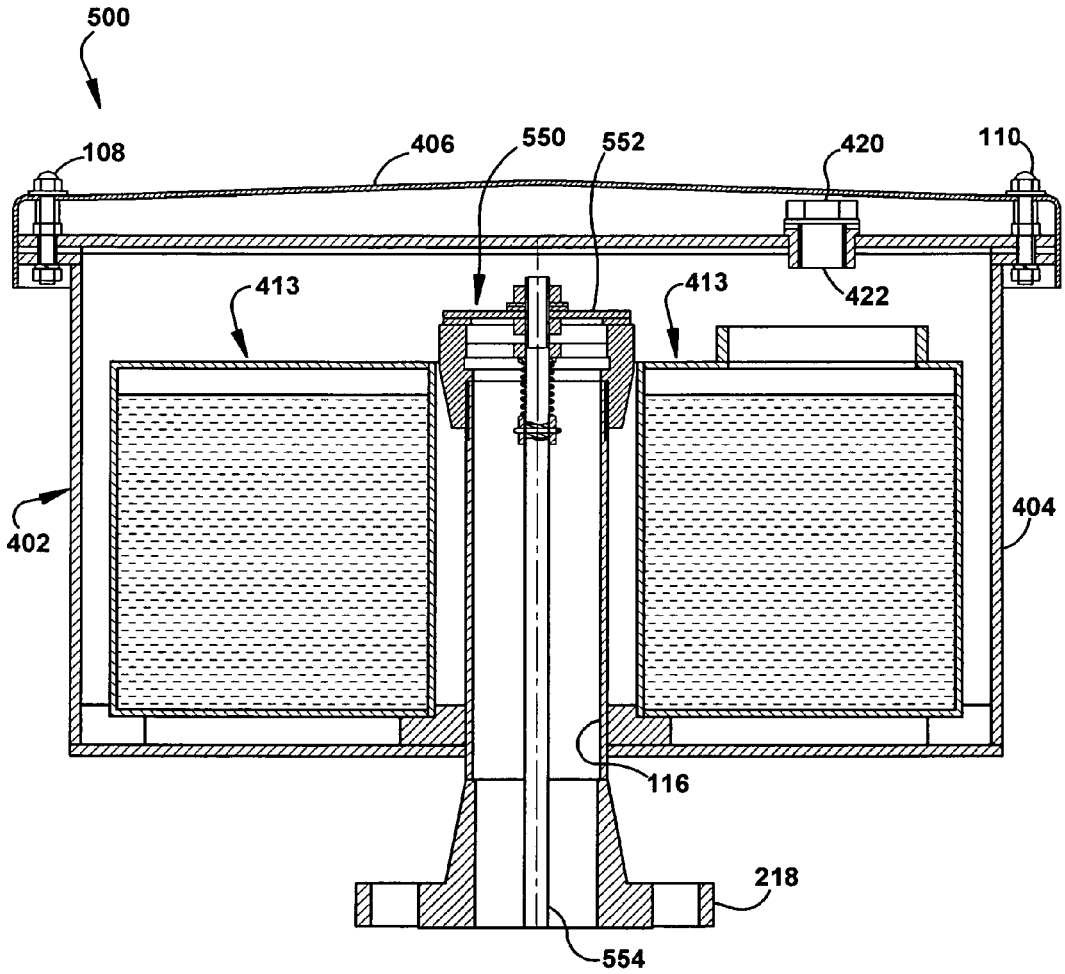

Turning to FIG. 2B, FIG. 2B illustrates a device 500 in accordance with another embodiment of the present invention. In FIG. 2B, like reference numerals refer to like parts. Device 500 is similar to device 400 except that resealable cover structure 220 is replaced with a float system 550 that permits device 500 to supply inhibitor based on the level of one or more liquids contained in an enclosure (e.g., an aboveground storage tank). Float system 550 is composed of a sealing valve 552 and a actuator 554. Actuator 554 is attached at is lower end to a float (not shown) that permits actuation of device 500 based on the level of a liquid in an enclosure. When the level of liquid in an enclosure is high enough is causes the float to actuate valve 552 thereby permitting the release of one or more corrosion inhibitors into the empty portion of an enclosure (e.g., an aboveground storage tank). In another embodiment, float system 550 could be replaced by a pressure sensitive valve. In this case, when, for example, a storage tank is filled the air pressure in the empty portion would increase thereby activating the pressure sensitive valve and causing the release of a corrosion inhibitor. Device 500 is particularly useful in the instances where the filling of an enclosure such as a storage tank causes the concentration of a corrosive atmosphere in the top of such an enclosure. Device 500 can be formed from the same or similar materials that are used to form the other devices of the present invention.

Figure 2C:
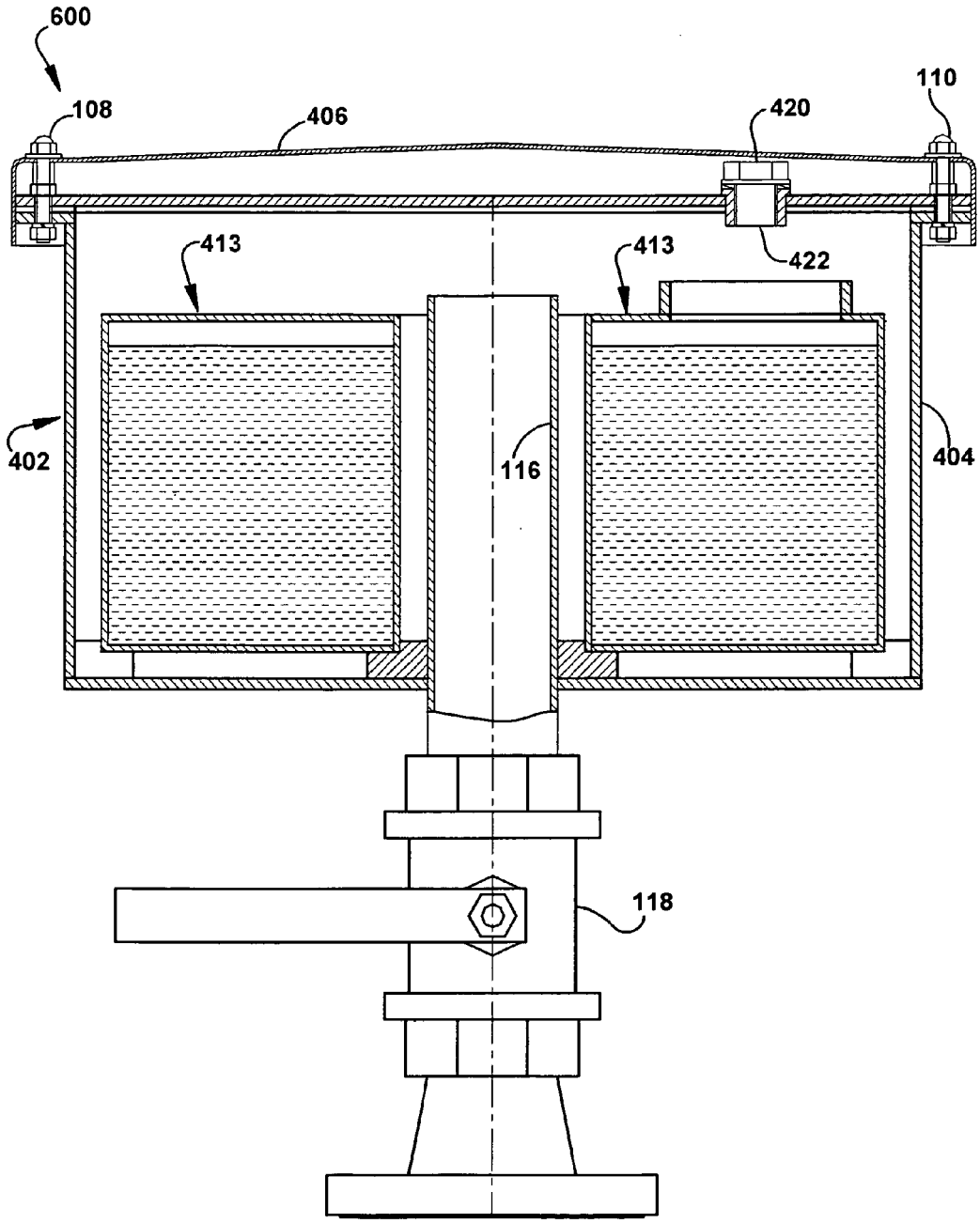

Turning to FIG. 2C, FIG. 2C illustrates a device 600 in accordance with another embodiment of the present invention. In FIG. 2C, like reference numerals refer to like parts. Device 600 is similar to device 100 and 400 except that device 600 is refillable due to the inclusion of plug 420 and fill-hole 422. Device 600 can be formed from the same or similar materials that are used to form the other devices of the present invention.

Figure 3A:
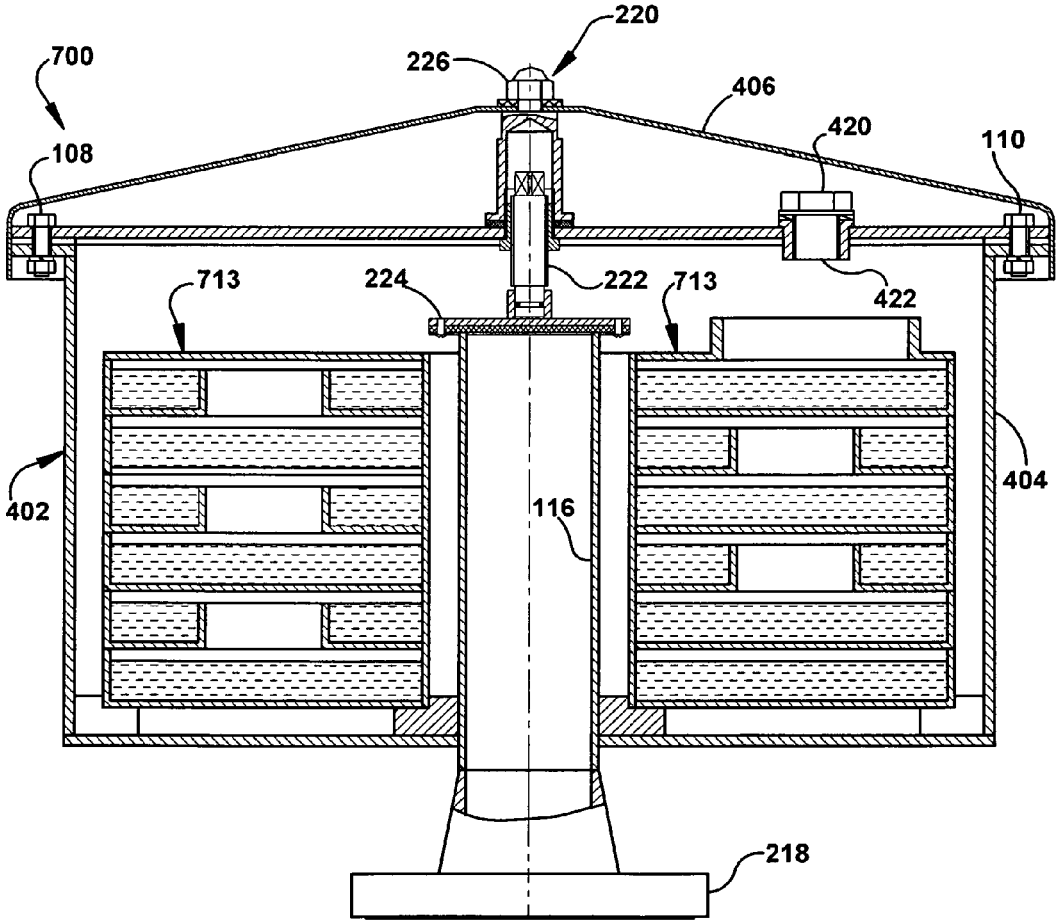

Turning to FIG. 3A, FIG. 3A illustrates a device 700 in accordance with another embodiment of the present invention. In FIG. 3A, like reference numerals refer to like parts. Device 700 is similar to device 400 except that reservoir 413 has been replaced with a multi-level reservoir 713. In this embodiment, due to the multi-level nature of reservoir 713, it is formed from some type of degradable material (e.g., a polymer material). As such, the degradable material of reservoir 713 is designed to degrade in the presence of one or more environmental factors such as water vapor, chlorine, heat, sunlight, UV rays, etc. Such polymer compounds that degrade in response to the aforementioned stimuli are known in the art and as such a discussion herein is omitted for the sake of brevity. Device 700 can be formed from the same or similar materials that are used to form the other devices of the present invention.

Figure 3B:
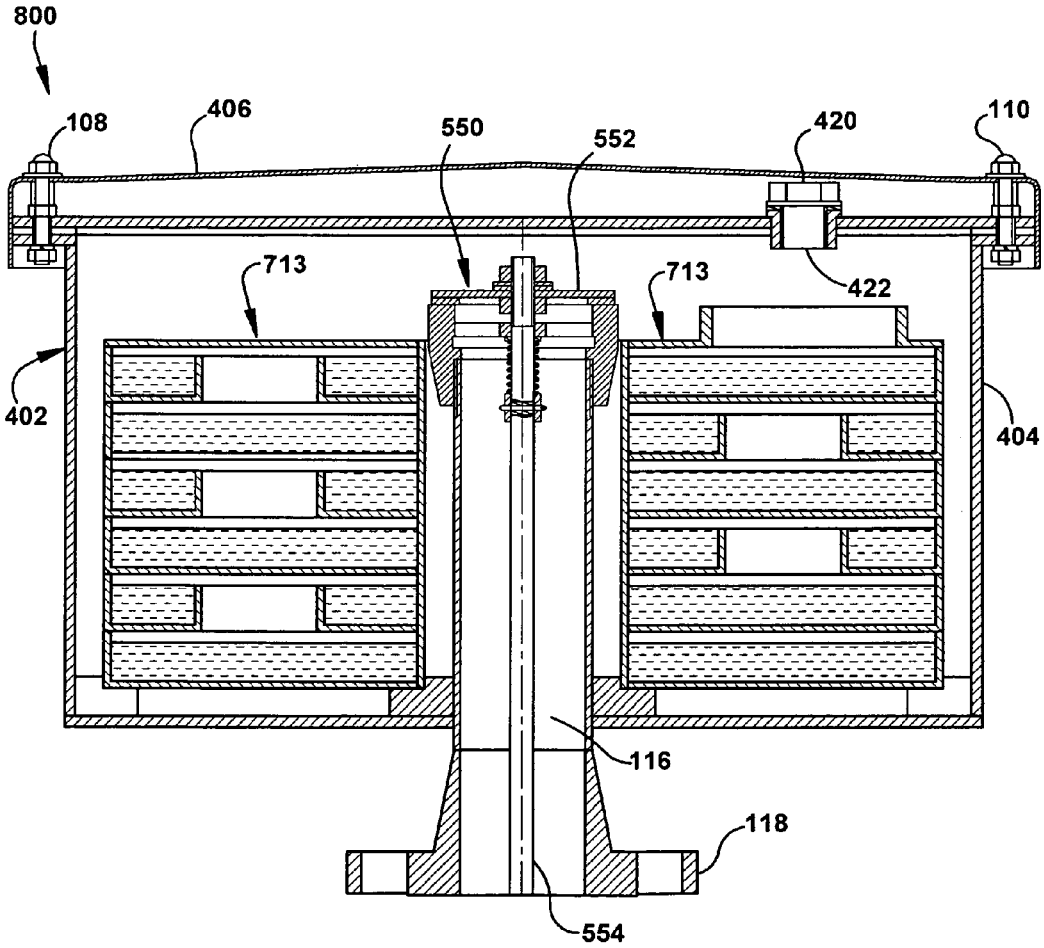

Turning to FIG. 3B, FIG. 3B illustrates a device 800 in accordance with another embodiment of the present invention. In FIG. 3B, like reference numerals refer to like parts. Device 800 is similar to device 500 except that reservoir 413 has been replaced with a multi-level reservoir 713. In this embodiment, due to the multi-level nature of reservoir 713, it is formed from some type of degradable material (e.g., a polymer material). As such, the degradable material of reservoir 713 is designed to degrade in the presence of one or more environmental factors such as water vapor, chlorine, heat, sunlight, UV rays, etc. Such polymer compounds that degrade in response to the aforementioned stimuli are known in the art and as such a discussion herein is omitted for the sake of brevity. Device 800 can be formed from the same or similar materials that are used to form the other devices of the present invention.

Figure 3C:
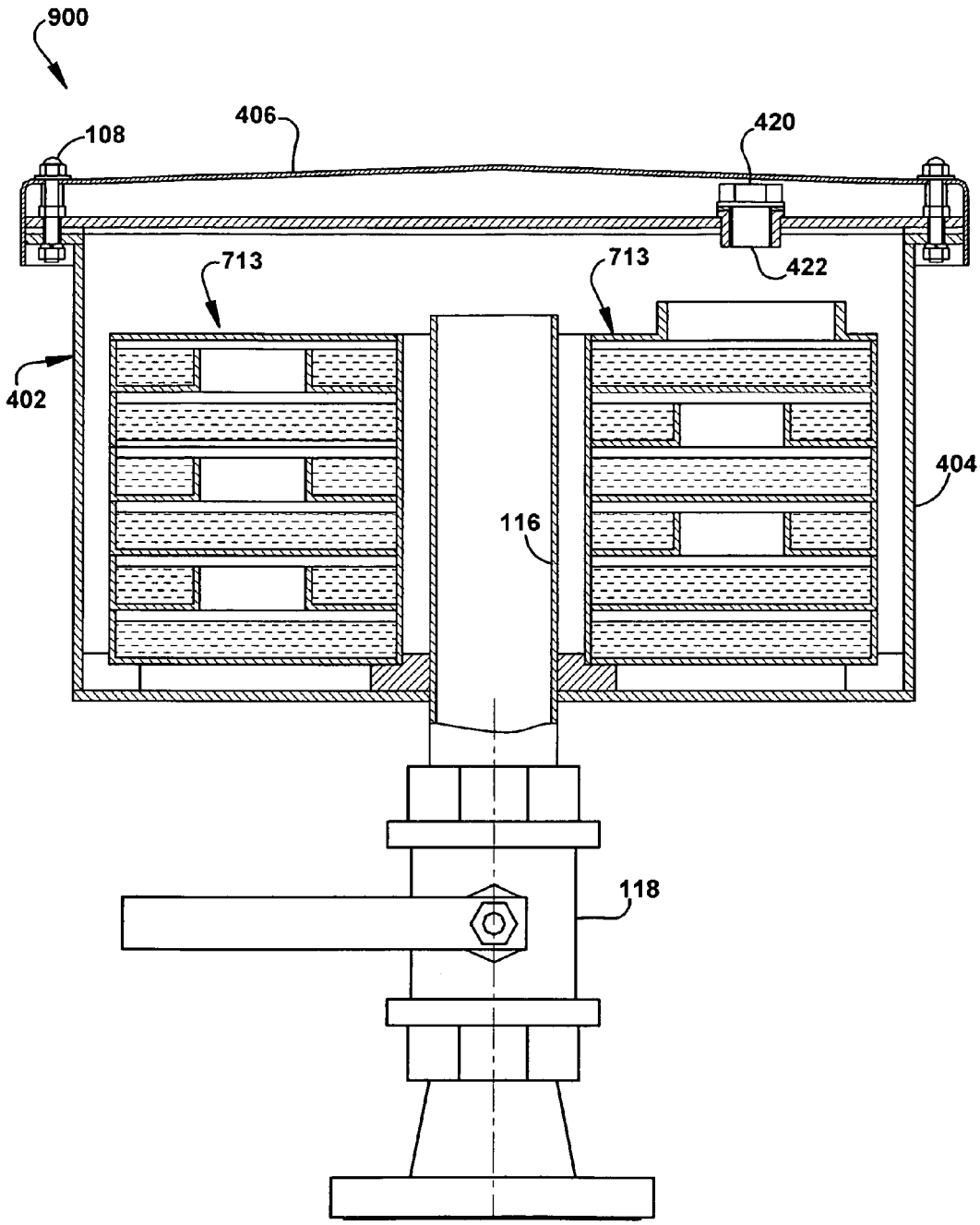

Turning to FIG. 3C, FIG. 3C illustrates a device 900 in accordance with another embodiment of the present invention. In FIG. 3C, like reference numerals refer to like parts. Device 900 is similar to devices 100 and 400 except that reservoir 413 has been replaced with a multi-level reservoir 713. In this embodiment, due to the multi-level nature of reservoir 713, it is formed from some type of degradable material (e.g., a polymer material). As such, the degradable material of reservoir 713 is designed to degrade in the presence of one or more environmental factors such as water vapor, chlorine, heat, sunlight, UV rays, etc. Such polymer compounds that degrade in response to the aforementioned stimuli are known in the art and as such a discussion herein is omitted for the sake of brevity. Device 900 can be formed from the same or similar materials that are used to form the other devices of the present invention.

Figure 4:
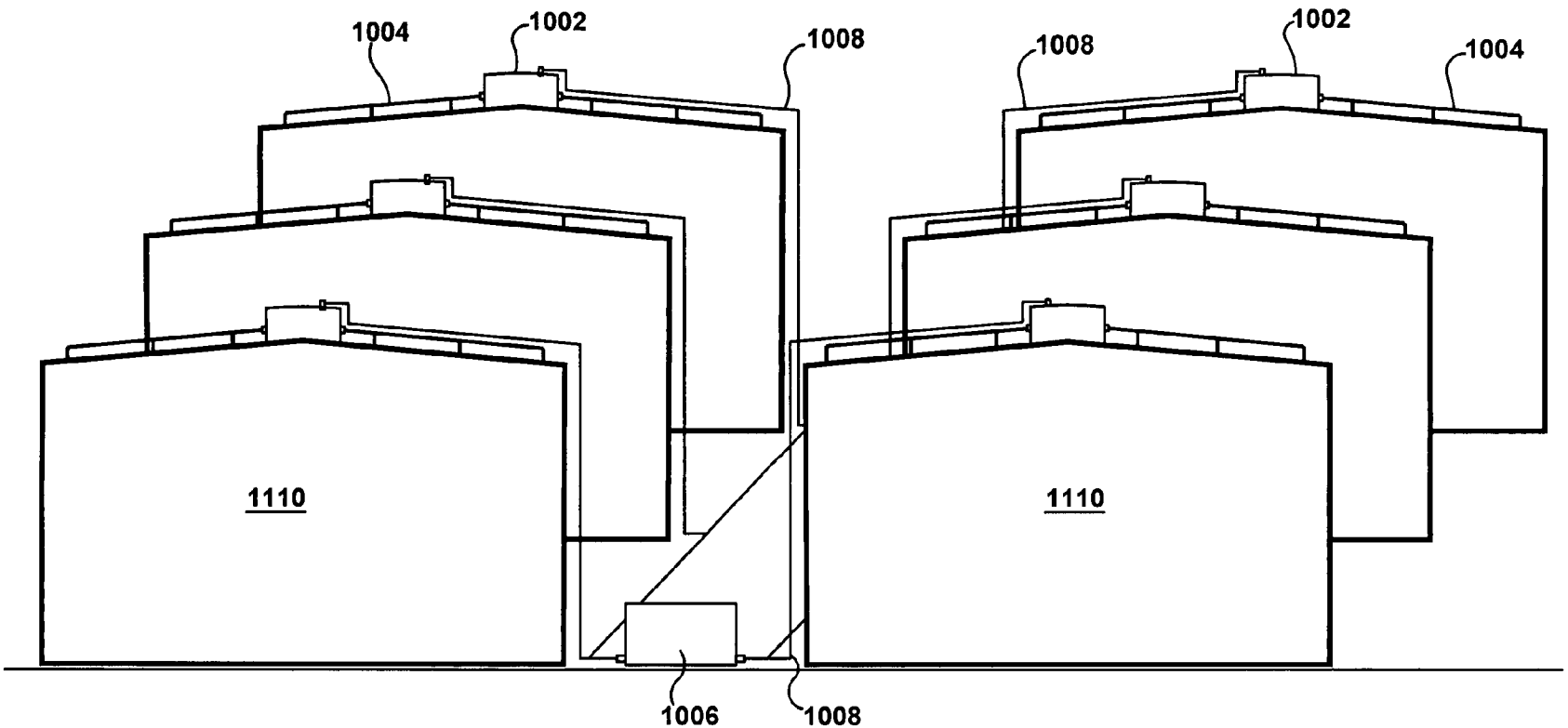
FIG. 4 is an illustration of a multi-tank protection system in accordance with one embodiment of the present invention.
Figure 5:
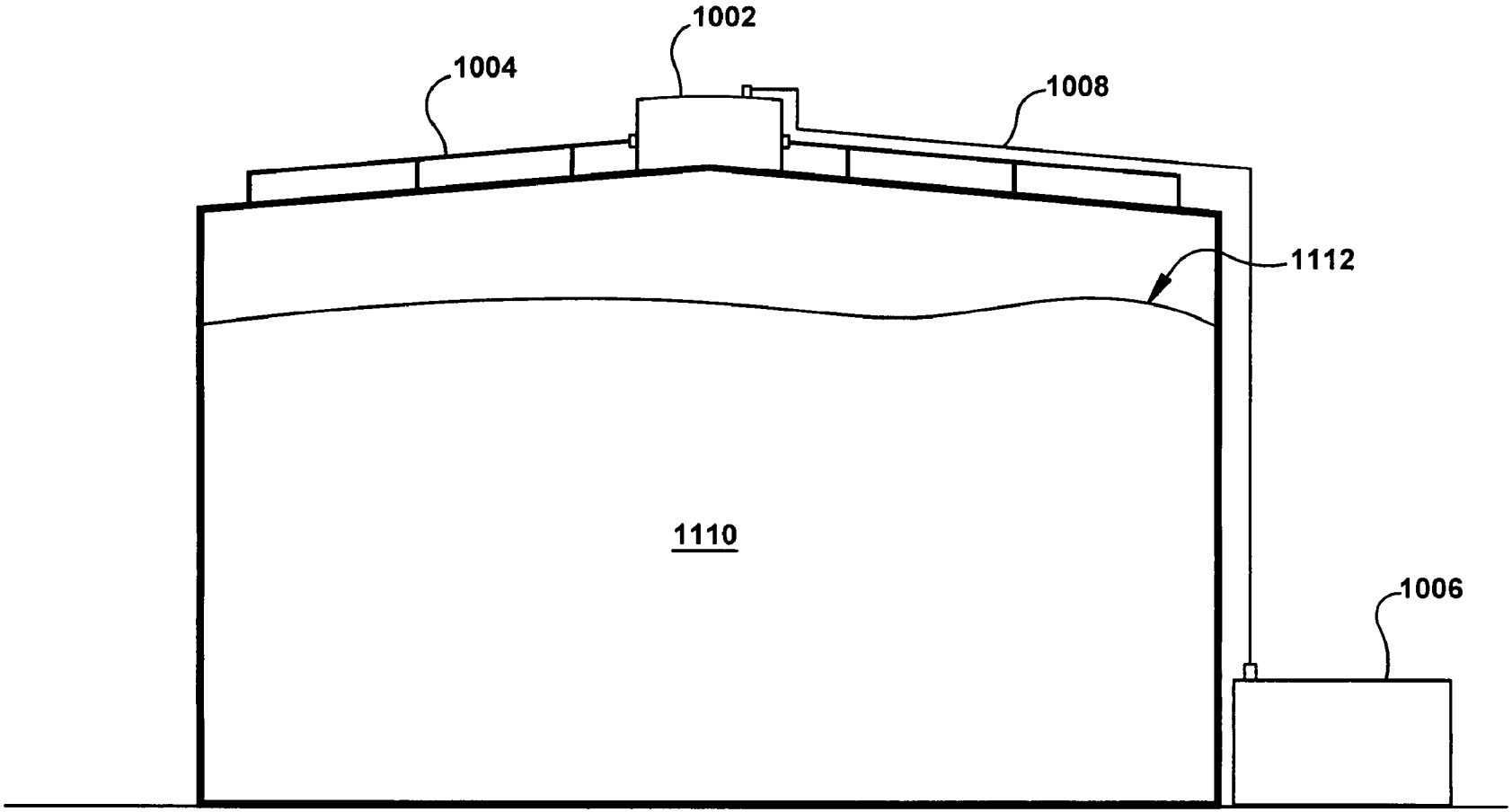
FIG. 5 is an illustration of a single tank protection system in accordance with one embodiment of the present invention.
Figure 9:
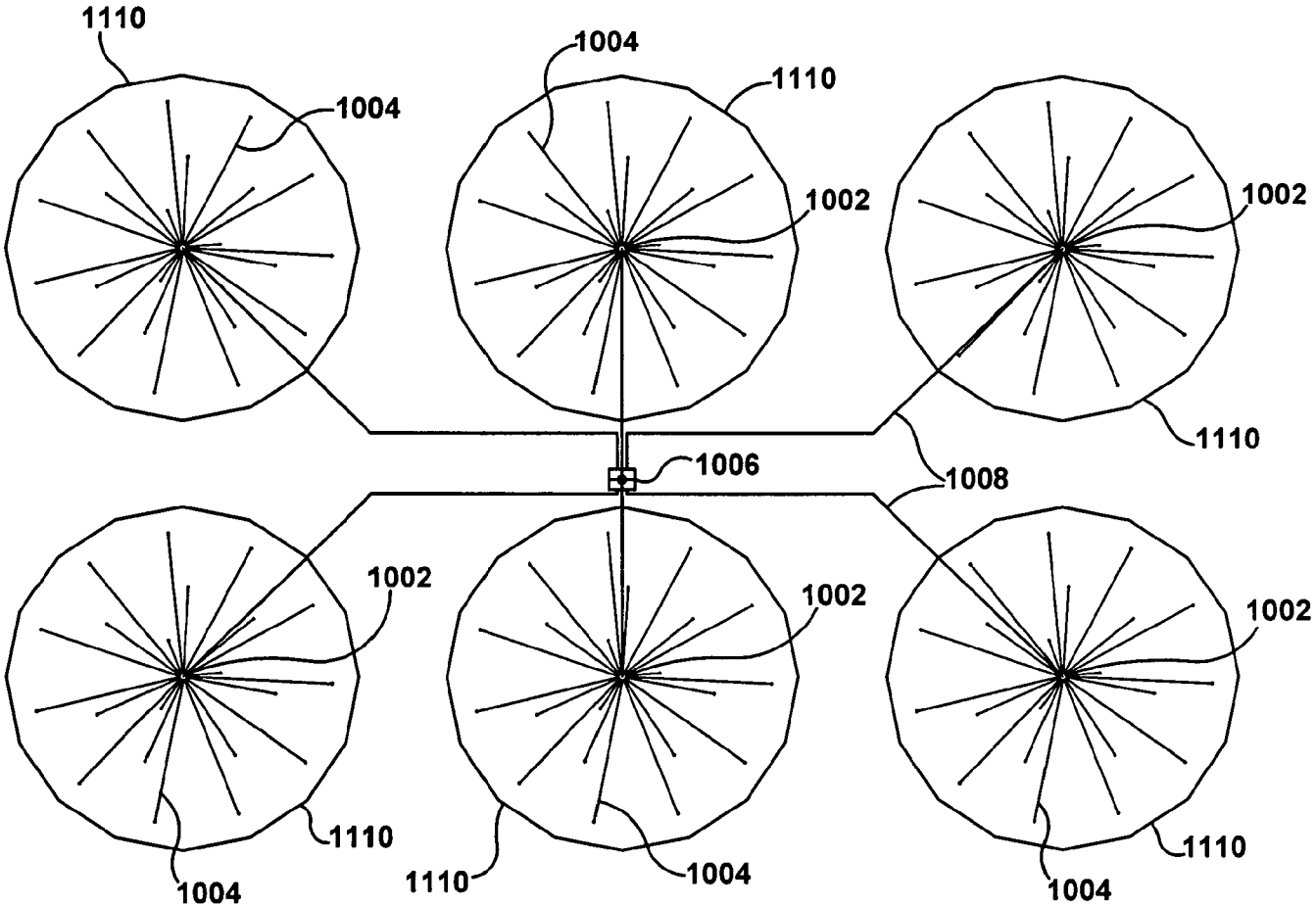
FIG. 9 is an illustrations of one embodiment of a multi-tank top systems in accordance with the present invention which utilizes at least one dispenser per tank where such dispensers are selected from the dispensers embodiments of FIGS. 1A through 3C, 6, 7, and 8.

As can be seen from FIGS. 1A through 3C, the dispensers disclosed therein are designed to be connected, interconnected, or attached to a suitable delivery system, such as the ones shown in FIGS. 4, 5 and 9, for delivering at least one corrosion inhibitor to at least one enclosure (e.g., a storage tank). Although valve-type or pipe-type connections are shown in relation to the embodiments of FIGS. 1A through 3C, the present invention is not limited thereto. Instead, any suitable type of connection can be used in the systems of the present invention. Additionally, the dispensers of the present invention can be one time use items or can be designed to be replenished.

In one embodiment, the dispensers of the present invention are designed from any suitable material. Such materials include, but are not limited to, metal, ceramics, plastics, or a combination of one or more of these types of materials. In one embodiment, the material used to form the one or more dispensers of the present invention are selected for their resistance to corrosion, or corrosive elements (e.g., $SO_x$, $NO_x$, chlorides, oxygen, $CO_2$, HCl, water, water vapor, etc.).

In one embodiment, the dispensers of the present invention can include programmable or computerized control systems in order to permit scheduled deliveries of one or more corrosion inhibitors, or some other compound, to an enclosure. In another embodiment, the dispensers of the present invention have the ability to detect the level of the one or more inhibitors within the enclosure in order to determine whether or not to deliver more corrosion inhibiting compound to the enclosure. In still another embodiment, the dispensers of the present invention have the ability to detect how much corrosion inhibiting compound to deliver to an enclosure in order to maintain a certain desired concentration of one or more inhibitors within an enclosure. In still another embodiment, the devices of the present invention can include one or more windows or inspection ports therein to allow for a person to visually inspect the interior of such a device. This is particularly useful in order to ascertain the amount of liquid-based corrosion inhibiting compound contained therein.

In another embodiment, the dispensers of the present invention permit the use of either high or low vapor pressure inhibitors at the same time. In another embodiment, the dispensers of the present invention permit the use of less or non-hazardous low vapor pressure inhibitors and can achieve high speed delivery of such inhibitors into an enclosure. In still another embodiment, the dispensers of the present invention prevent waste of one or more corrosion inhibiting compounds by selectively delivering such compounds only when need (e.g., as determined by a set program, as determined in response to a sensor, etc.).

Turning to FIG. 4, FIG. 4 illustrates the application of various embodiments of the devices of the present invention to a field of aboveground storage tanks. It should be noted that the present invention is not limited to just the application shown in FIG. 4. Rather, the applications for the devices of the present invention are to be broadly construed in accordance with the discussion above. FIG. 5 is similar in nature to FIG. 4, except that it illustrates a one tank system rather than a multi-tank system. It should be noted that the number of tanks to which the systems of the present invention are applied is not critical. As such, any number of tanks can be protected by just increasing the number of reservoirs and amount of piping utilized.

In FIGS. 4 and 5 corrosion inhibitor dispensers in accordance with devices 100, 200, 300, 400, 500, 600, 700, 800, 900, 1200, 1300, and/or 1400 can be used as corrosion protection device 1002. As would be apparent to those of skill in the art, any variety of devices can be used. As such, the present invention is not limited to the instance where all of corrosion protection devices 1002 are identical in nature. Additionally, as can be seen from FIGS. 4 and 5, devices 100, 200, 300, 400,

500, 600, 700, 800 and 900 can have multiple supply points rather than just the single supply point shown in FIGS. 1A through 3C.

In light of the above, each device 1002 is connected to at least one storage tank 1110 in order to provide corrosion protection thereto. In the embodiments of FIGS. 4 and 5, each device 1002 is connected at multiple points to storage tanks 1110 via piping 1004. Additionally, the one or more corrosion inhibitors contained within each of device 1002 can be replenished from reservoir 1006 via supply piping 1008. As such, devices 1002 can have virtually unlimited service lives. As is noted above, the devices of the present invention seek to protect the upper unfilled portion of a storage tank when the level of liquid 1112 therein is such that an air space exists within the confines of tank 1110.

Figure 6:
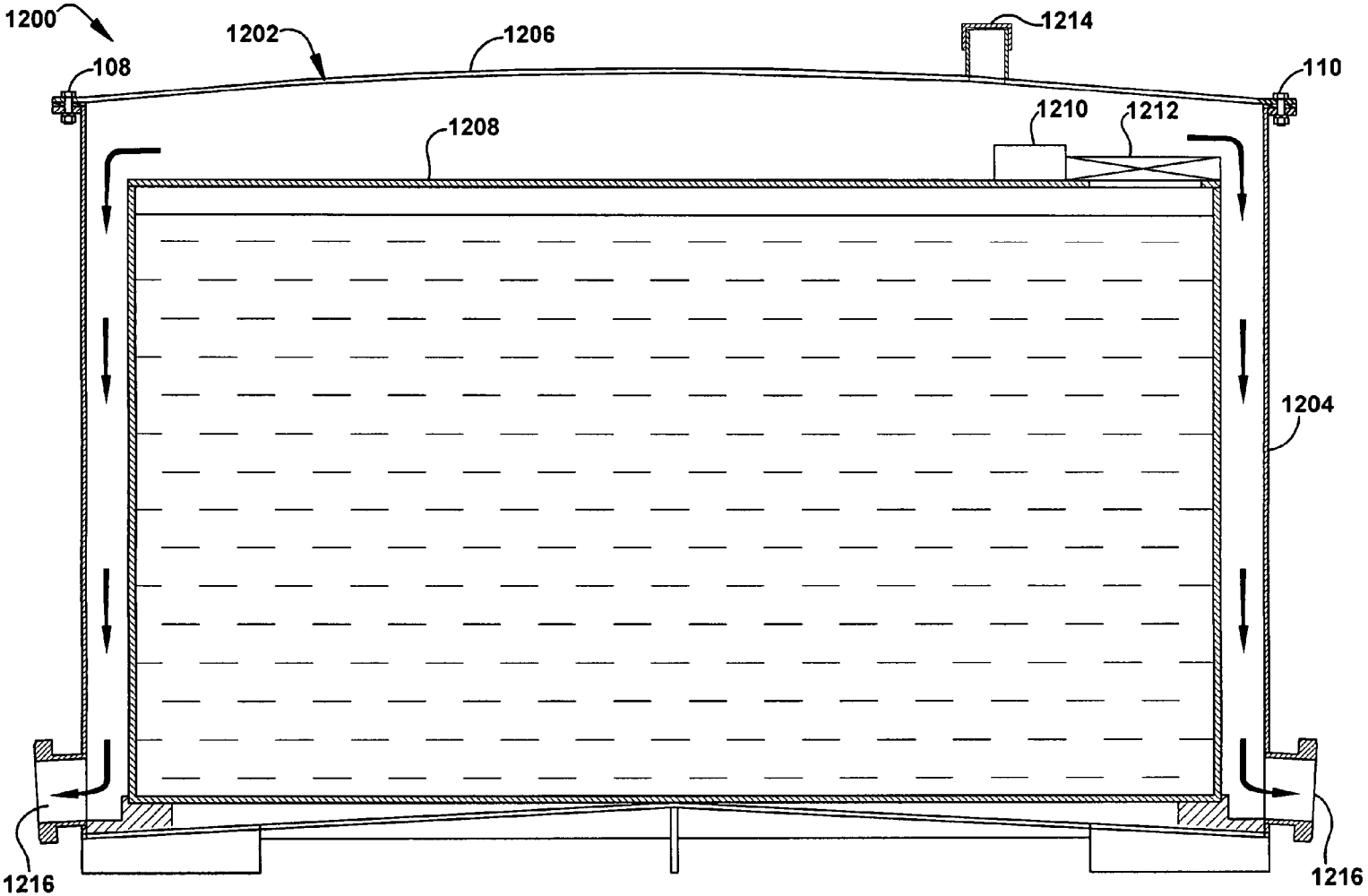
FIGS. 6 through 8 are cross-sectional illustrations of various dispensers for dispensing at least one corrosion inhibiting compound in accordance with one or more systems of the present invention.

Turning to FIG. 6, FIG. 6 illustrates a corrosion inhibiting device in accordance with another embodiment of the present invention. Device 1200 of FIG. 6 is comprised of a resealable housing 1202 formed from base 1204 and top 1206. Resealable housing 1202 can be open and closed via fasteners 108 and 110 and can be formed from any suitable material that is both durable and watertight. By durable it is meant that the material that is used to form housing 1202 should remain durable and structurally intact for at least about 6 months. By watertight it is meant that water vapor should not be able to pass through the material used to form housing 1202. Suitable materials for the formation of housing 1202 include, but are not limited to, metal, ceramic, polymers, or combinations of two or more thereof. In one embodiment, a rust resistant metal (e.g., aluminum or stainless steel), ceramic or polymer material is used to form housing 1202. Suitable polymer materials include, but are not limited to, polystyrenes, polypropylenes, polyethylenes, polyolefins, or combinations of two or more thereof. In another embodiment, the polymer used to form housing 1202 of the present invention contain one or more metallized layers (e.g., vapor deposited aluminum layers). Such metallized films are known in the art and as such a discussion thereof is omitted for the sake of brevity. If formed from a polymer material, housing 1202 can be formed from any suitable technique including, but not limited to, blow molding, casting, extrusion, etc. In some embodiments, the polymer materials that are used to form housing 1202 can further include a wide variety of polymer modification compounds including, but not limited to, processing aids, UV stabilizers, flame-retardants, anti-mildew compounds, anti-static compounds, anti-bacterial compounds, dyes, colorants, or any combination of two or more thereof.

Regarding resealable housing 1202, housing 1202 is not limited to just the fastener embodiment discussed above. Rather, any suitable type of sealing system that permits repeated opening and closing of housing 1202 can be used. Suitable sealing systems include, but are not limited to, tape, hinges, screws, bolts, resealable adhesives, or combinations of two or more thereof.

Device 1200 further comprises one or more corrosion inhibitor reservoirs 1208. Reservoir 1208 can be similar in nature to the reservoirs of FIGS. 1A through 3C. As such, a detailed description of reservoir 1208 is omitted for the sake of brevity. In device 1200 reservoir 1208 is connected to a valve 1212 and a valve controller 1210 that are designed to supply one or more corrosion inhibiting compounds to the interior of housing 1202 so that the vapor thereof can flow (see the arrows of FIG. 6) out into supply lines and be transmitted, via connections 1216 to a tank (see FIG. 5). As would be apparent to those of skill in the art, device 1200 is not limited to just two as is illustrated in FIG. 6. Rather, any number of connectors can be used depending on, for example, the size of device 1200. Device 1200 also permits the checking and refilling of the corrosion inhibitor contained therein via resealable opening 1214.

Figure 7:
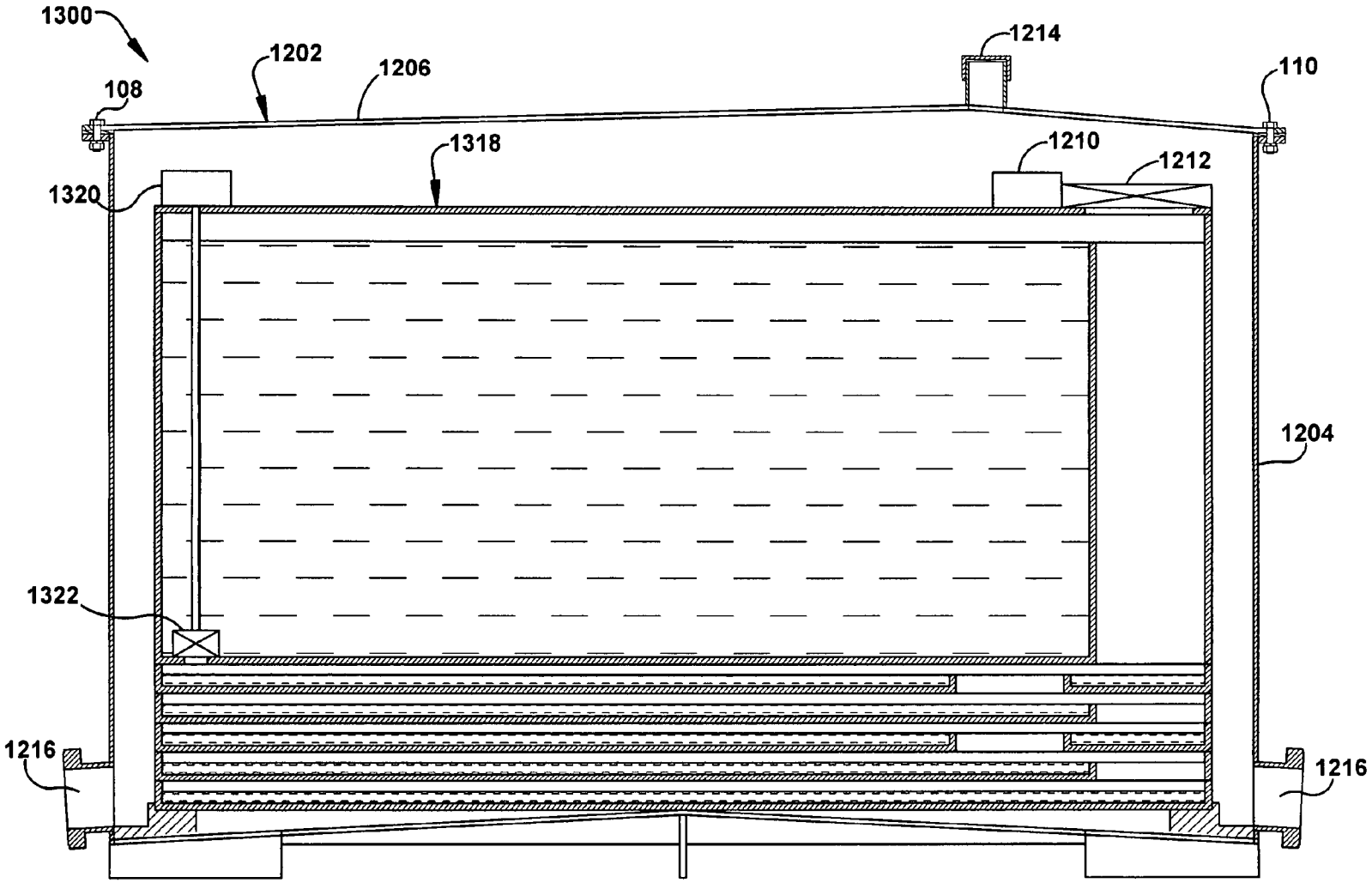

Turning to FIG. 7, FIG. 7 illustrates a device 1300 in accordance, with another embodiment of the present invention. In FIG. 7, like reference numerals refer to like parts. Device 1300 is similar to device 1200 except that reservoir 1208 has been replaced with a multi-level reservoir 1318. In view of this change, a second valve 1322 and valve controller 1320 are added to permit the delivery of corrosion inhibitor from the multi-level reservoir. One advantage of the multi-level reservoirs of the present invention are that they permit the use of two or more different corrosion inhibitors. This is desirable in the instances where protection against two or more corrosive compounds is sought. Device 1300 can be formed from the same or similar materials that are used to form the other devices of the present invention.

Figure 8:
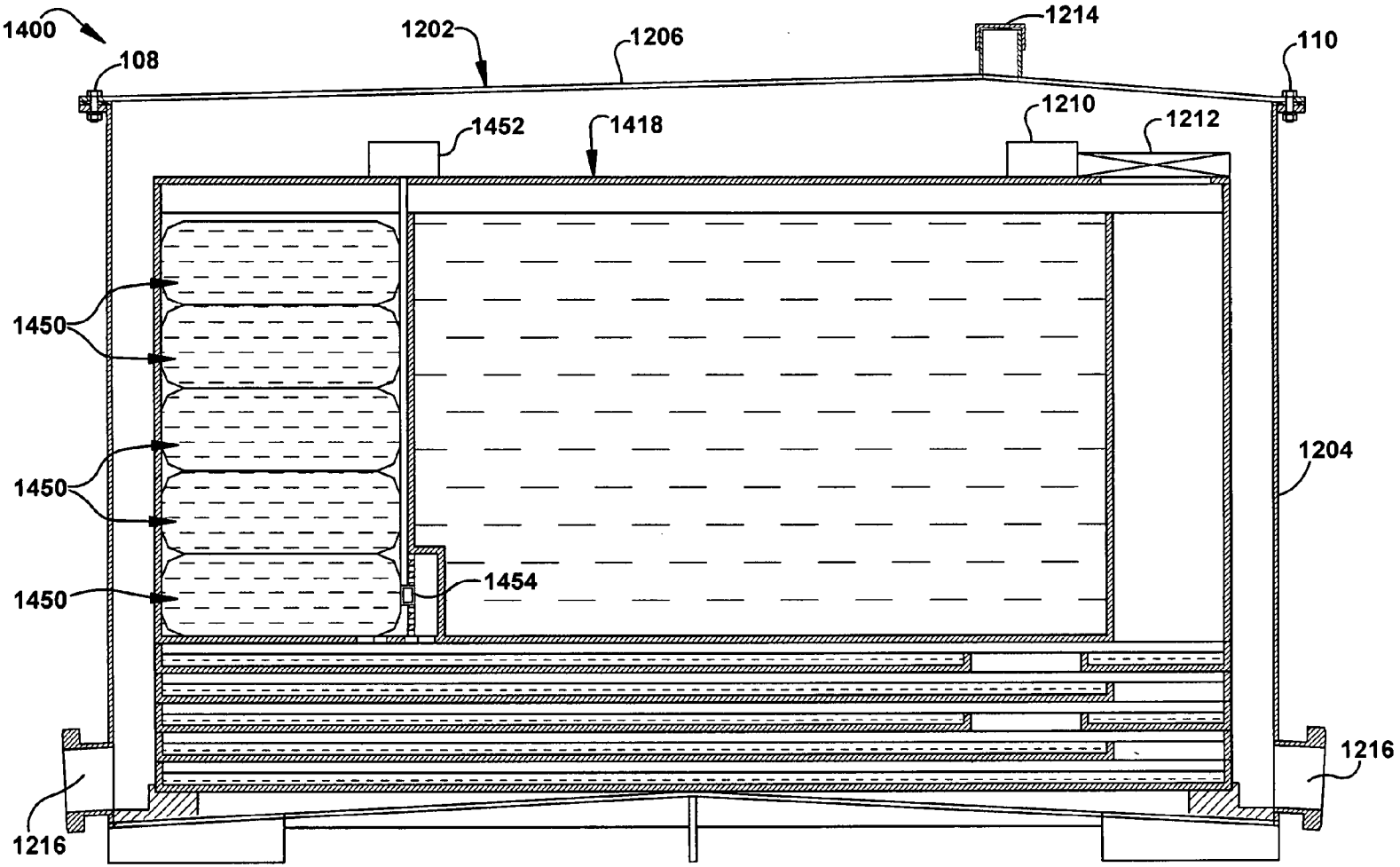

Turning to FIG. 8, FIG. 8 illustrates a device 1400 in accordance with another embodiment of the present invention. In FIG. 8, like reference numerals refer to like parts. Device 1400 is similar to device 1300 except that reservoir 1318 has been replaced with a multi-level, multi-phase reservoir 1418 that includes therein a multiple bags 1450 of liquid corrosion inhibitor. In view of this change, a controller 1452 and puncturing device 1454 are provided. This embodiment enables the quick release of a large amount of corrosion inhibitor via the puncturing of one or more of bags 1450. This is desirable where a high initial concentration of corrosion inhibitor is needed (e.g., in a newly constructed and filled storage tank). Device 1400 can be formed from the same or similar materials that are used to form the other devices of the present invention.

Turning to FIG. 9, FIG. 9 is a top down view of the system of FIG. 4 where like reference numerals represent like parts. Given this, a further explanation of FIG. 9 is omitted for the sake of brevity.

In one embodiment, devices 1200, 1300 and 1400 of the present invention are designed from any suitable material. Such materials include, but are not limited to, metal, ceramics, plastics, or a combination of one or more of these types of materials. In one embodiment, the material used to form the one or more dispensers of the present invention are selected for their resistance to corrosion, or corrosive elements (e.g., $SO_x$, $NO_x$, chlorides, oxygen, $CO_2$, HCl, water, water vapor, etc.). Additionally, various portions of devices 1200, 1300 and 1400 can be formed from materials discussed in the embodiments above.

In one embodiment, the dispensers of the present invention can include programmable or computerized control systems in order to permit scheduled deliveries of one or more corrosion inhibitors, or some other compound, to an enclosure. In another embodiment, the dispensers of the present invention have the ability to detect the level of the one or more inhibitors within the enclosure in order to determine whether or not to deliver more corrosion inhibiting compound to the enclosure. In still another embodiment, the dispensers of the present invention have the ability to detect how much corrosion inhibiting compound to deliver to an enclosure in order to maintain a certain desired concentration of one or more inhibitors within an enclosure.

In another embodiment, the dispensers of the present invention permit the use of either high or low vapor pressure inhibitors at the same time. In another embodiment, the dispensers of the present invention permit the use of less or non-hazardous low vapor pressure inhibitors and can achieve high speed delivery of such inhibitors into an enclosure. In still another embodiment, the dispensers of the present invention prevent waste of one or more corrosion inhibiting compounds by selectively delivering such compounds only when need (e.g., as determined by a set program, as determined in response to a sensor, etc.).

In still another embodiment, the present invention relates to systems that utilize one or more dispensers disclosed therein (FIGS. 1A through 3C, 6, 7, and 8) to reduce or eliminate corrosion in at least one enclosure top. Exemplary systems according to the present invention are illustrated in FIGS. 4, 5 and 9.

Some of the advantages associated with the present invention are as follows:

(a) the dispensers and/or systems of the present invention permit one to choose the speed of inhibitors delivery depending the vapor space volume;

(b) the dispensers and/or systems of the present invention permit one to replace the one or more inhibitors, or inhibiting compounds, without having to take an enclosure out of operation/service; and (c) the dispensers and/or systems of the present invention can be applied to existing and/or new enclosures.

In one embodiment, the devices of the present invention deliver one or more volatile or vapor phase corrosion inhibitors to an environment in which they are placed, connected to, or in communication with by any suitable delivery means. Such delivery means include, but are not limited to, one way diaphragms, two way diaphragms, semi-permeable membranes, valves (e.g., pressure sensitive valves, electronic valves, etc.) which allow the passage of corrosion inhibitor out of the device but prevent the inflow of the liquid or vapor phase environment which surrounds the device, a decomposable metal or polymeric plug or a decomposable corrosion inhibitor impregnated polymer film. In another embodiment, if an electronic valve is incorporated into the devices of this portion of the present invention, the electronic valve can be constructed and/or programmed so as to release corrosion inhibitor at regular intervals and/or in regular amounts. For example, an electronic valve could be set to release corrosion inhibitor from a device according to this portion of the present invention once every day, week, month or year. Alternatively, an electronic valve could be set to release corrosion inhibitor every other day, week, month or year. It should be noted, that this portion of the present invention is not limited to any one interval scheme. Rather, if incorporated in the devices according to this portion of the present invention, an electronic valve can be set to dispense corrosion inhibitor at any given regular or irregular interval.

In another embodiment, the devices of this additional portion of the present invention can contain therein a sensor for detecting the concentration of various corrosive environments. In response to a certain threshold pressure or concentration of corrosive gas, corrosive liquid, corrosive ions, etc., the sensor instructs the electronic valve to release corrosion inhibitor for a certain amount of time. In another embodiment, the electronic valve is equipped with a flow meter and can dispense any desired amount of corrosion inhibitor (be it liquid or gas). Such an electronic valve is useful in situations where a known amount of corrosive material collects (or forms) over a given period of time.

In yet another embodiment, the devices of this additional portion of the present invention can incorporate therein dissolvable or degradable plugs which dissolve or degrade in the presence of one or more corrosive elements over time or dissolve or degrade in a given environment. For example, a plug could be designed to degrade in the presence of water, water vapor, or water condensation thereby permitting the release corrosion inhibitor into the interior of an enclosure or storage tank via any suitable delivery means (e.g., pipes, conduits, etc.). In another embodiment, the degradable plug could be made of a metal which breaks down quickly in the presence of oxygen (e.g., magnesium).

Although the invention has been shown and described with respect to certain embodiments, it is obvious that equivalent alterations and modifications will occur to others skilled in the art upon the reading and understanding of this specification. In particular with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A method for providing corrosion protection to a container subject to corrosion comprising the steps of:

(A) providing a device comprising at least one corrosion inhibiting portion contained therein, the corrosion inhibiting portion comprising at least one vapor phase corrosion inhibitor, wherein the device further comprises a delivery system for achieving the selective and controlled release of the at least one vapor phase corrosion inhibitor;

(B) placing the device into communication with the container subject to corrosion; and (C) permitting the delivery system to selectively control the release of the vapor phase corrosion inhibitor into the container subject to corrosion over an extended period of time, wherein the device is designed to respond to the level of one or more liquids contained in the container to be protected.

2. The method of claim 1, wherein the device further comprises a sensor for detecting the concentration of one or more corrosive compounds in the container.

3. The method of claim 1, wherein the device further comprises a status monitoring system.

4. The method of claim 3, wherein the status monitoring system permits one to monitor the amount of corrosion inhibitor remaining in the device.

5. The method of claim 1, wherein the device is resealable.

6. The method of claim 1, wherein the device is formed from a polymer material.

7. The method of claim 1, wherein the device is flame resistant.

8. The method of claim 1, wherein the service life of the device is in the range of about 1 month to about 50 years.

9. The method of claim 1, wherein the service life of the device is in the range of about 6 months to about 25 years.

10. The method of claim 1, wherein the service life of the device is in the range of about 1 year to about 15 years.

11. The method of claim 1, wherein the container to be protected is selected from a storage tank, a cistern, a shipping container, or a metal enclosure.

12. The method of claim 11, wherein the container to be protected is an aboveground storage tank.

* * * * *